United States Patent [19]

Ghaly

[11] Patent Number: 4,948,124

[45] Date of Patent: Aug. 14, 1990

[54] EXERCISE MACHINE AND TOY

[76] Inventor: Azmy W. Ghaly, 2122, 24 Av. S., Mpls., Minn. 55406

[21] Appl. No.: 390,112

[22] Filed: Aug. 7, 1989

[51] Int. Cl.[5] ..... A63B 21/015; A63B 22/14; A63B 22/20

[52] U.S. Cl. ..... 272/132; 272/114; 272/146; 280/87.041; 280/87.043

[58] Field of Search ..... 272/30, 31 A, 31 R, 272/33, 70, 93, 126, 127, 129, 130, 134, 146, 114, 115, 131, 132; 128/25 R; 280/87.041, 87.043

[56] References Cited

U.S. PATENT DOCUMENTS

| | | | |
|---|---|---|---|
| 3,911,907 | 10/1975 | Smith, Jr. | 128/25 R |
| 4,391,441 | 7/1983 | Jimjian | 272/146 X |
| 4,515,363 | 5/1985 | Schleffendorf | 272/146 X |
| 4,638,996 | 1/1987 | Simjian | 272/126 X |
| 4,799,475 | 1/1989 | Iams et al. | 128/25 R |

OTHER PUBLICATIONS

The "Twisting Exercise Machine" Shown In Jet Magazine; Feb. 6, 1989; p. 45.

*Primary Examiner*—Robert W. Bahr

[57] ABSTRACT

A machine has a base which supports a vertical shaft with handles and foot pads on a disc pivoted at its center and is linked to the shaft which has an adjustable resistance for the exerciser to build his body's strength. Also, mounted into the center of the disc, a swinging seat that oscillates freely sideways and vertically for the exerciser to sit down if he desires while exercising. In addition, under the base is a steering wheel attached to the lower end of the shaft, and two wheels which are driven by a motor, are mounted beneath the base, so that the exerciser manipulates the steering wheel by the handles to follow certain track on the floor and an electronoic eye scores each instant of missing the track in a competition of exercise and fun. Moreover, without a live exerciser, the machine can use a motor and a pitman rod mechanism which sets the machine in motion, displaying a pleasing performance of its moving parts as a fascinating toy, specially when a doll of some charecter is attached to the machine instead of the exercising person. The exercise machine can be constructed to be water-proof suitable to be put into water while it is manipulated by the exerciser.

6 Claims, 3 Drawing Sheets

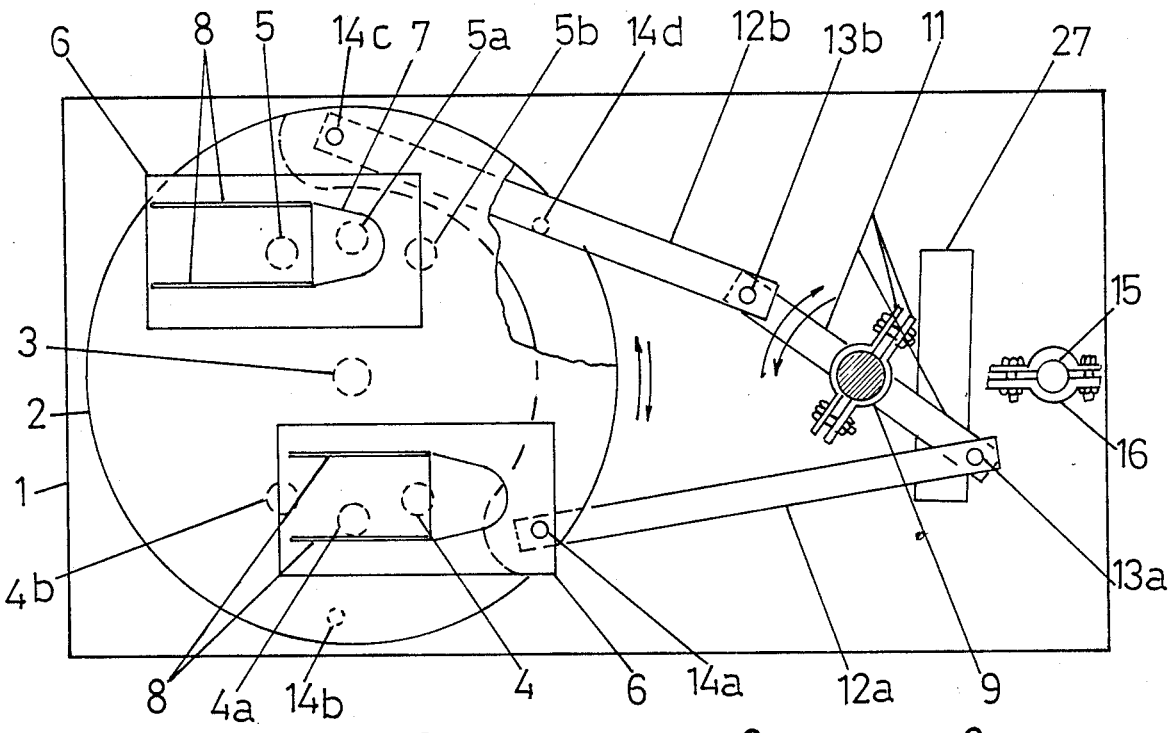
FIG 2
FIG 3
FIG 4
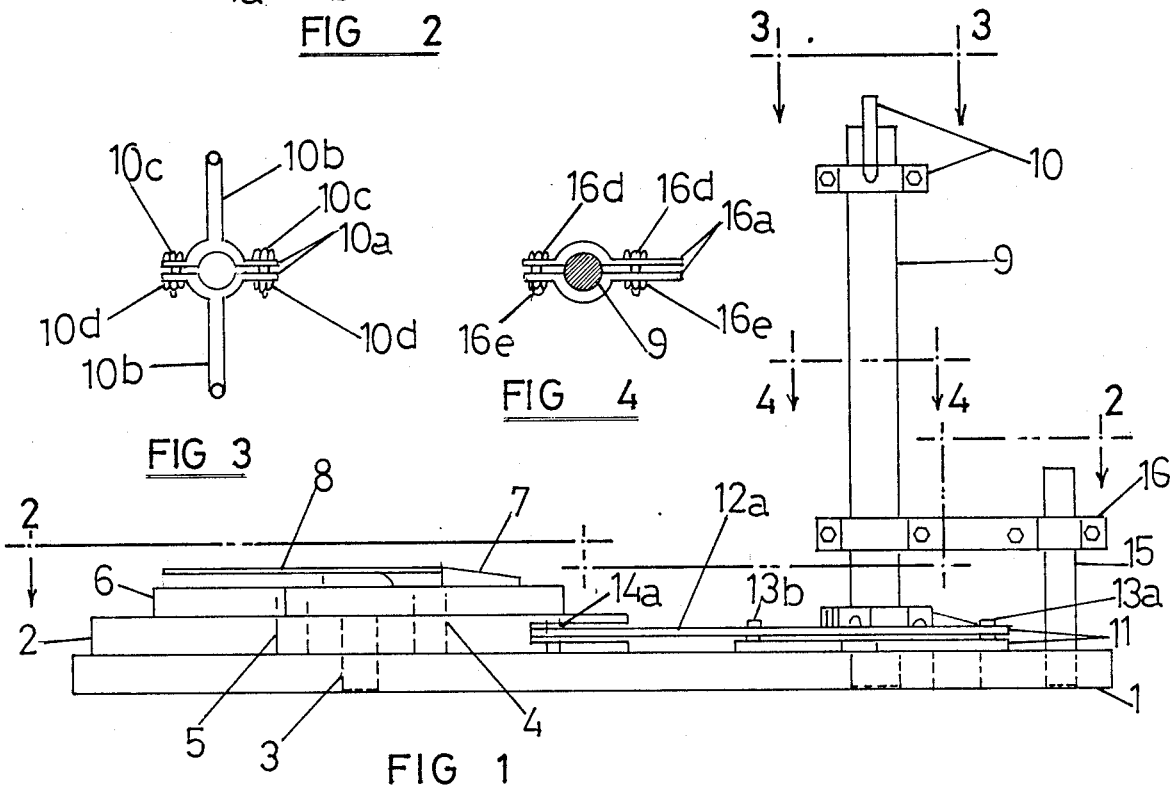
FIG 1

12a
12b 12a
12b
12d 12c
8
7a 6a
66
7
11
11
8
8

6a
6b
7
8
6a 13a,14a
13b,14c 3,4,5

11c
11d
11b
11d
11a
11a
11e
11e
11b
11c

15

10b
10c
10c
10a
10a
10d 10b
10d
10b
10a
10d

15

11e
11c
11b
11a 16d
16d
16b
16b
16a
16a
16e
16e 16c
16c
16a
16e 16c
2c
2e
2
2a
2b
2d 2
2f 1a
1b
27
1c
A
B
1

1

EXERCISE MACHINE AND TOY

BACKGROUND OF THE INVENTION

1. Field of the Invention:

The invention relates to machines used for physical exercises and also for competition to win and have more fun.

2. The Prior Art:

The prior art describes machines only for exercise of specific parts of the body and, in the meantime, are not propelled or suitable for the fun of winning in a competition, and so, the invention fulfills useful purposes than the prior art. The invention is flexible and economical to exercise the whole body in harmony and normal position, using one machine, which is of utmost advantage than the prior art.

The competition is not only fun but it also creates easy and good exercise and keeping healthy body. The invention though devoted to exercising of the body for health, is also fascinating and eye-pleasing as a flexible popular toy, especially when it is made of the colorful plastics in mini and other sizes. The invention with a motor mechanism, is a propelled exercise machine with a steering wheel, so that said invention can be used for fun, competition and exercise in the same time.

The detailed description, of the invention, shows the use of the invention is not limited per one's imagination.

SUMMARY OF THE INVENTION

The invention is a machine, which can be propelled and steered. It is equipped with a motor mechanism. The invention, primarily, is used to exercise the whole body of the user, for health, while in a normal position which is a great advantage and different from the prior art known to the inventor. The invention can be actuated by the legs, the arms or both simultaneously, and by a motor mechanism. In addition to the normal useful exercise of the whole body, the invention, when used in competition to win, promotes and provides good exercise of not only the body of the user, but also his senses as he manipulates and directs the invention in the competition. The invention also uses simple linkage mechanisms and adjustable resistance to suit the age and the health condition of the exerciser. The advantages of the invention distinguish it from the prior art which in most cases devoted to exercise specific parts of the body and is not suitable for the fun and excitement of competitions because the invention has propelling wheels and a steering wheel which is manipulated by the user. These distinctions will be known from the many possible embodiments of the invention.

BRIEF DESCRIPTION OF THE DRAWINGS (1) FIG. 1 is a front view of partial assembly of the physical exercising machine in accordance with the invention.

(2) FIG. 2 is a section top view of FIG. 1 in the direction of the view (2—2) shown in FIG. 1.

(3) FIG. 3 shows the details of the handle assembly item 10 in FIG. 1 (view 3—3).

(4) FIG. 4 shows the clamping assembly item 16 in FIG. 1 as seen in section view (4—4) in FIG. 1.

(5) FIGS. 5 and 6 are a top and a side views respectively of the base board item 1 in FIG. 1. In FIG. 5 (A–B) is a center line.

(6) FIGS. 7 and 8 are a top and a side views respectively of the disc item 2 in FIG. 1.

(7) FIGS. 9 and 10 are a top and a side views respectively of the handle assembly item 10 in FIG. 1.

(8) FIG. 11 is a section view (11—11) in FIG. 23.

(9) FIGS. 12 and 13 are a side and a top views respectively of the clamping assembly item 16 in FIG. 1.

(10) FIGS. 14 and 15 are a side and a top views respectively of the cross bar assembly item 11 in FIGS. 1 and 2.

(11) FIGS. 16 and 17 are a front and a top views respectively of the pivot pin item **13*a* or 13*b* or 14*a* or 14*c* in FIGS. 1 and 2**.

(12) FIGS. 18 and 19 are a front and a top views respectively of the primary pivot pin item 3 or 4 or 5 in FIG. 1.

(13) FIGS. 20 and 21 are a front and a top views respectively of the linkage member item **12*a* or 12*b* in FIG. 2**.

(14) FIGS. 22 and 23 are a front and a top views respectively of the means for retaining the foot of the user which are also shown as items 6, 7 and 8 in FIGS. 1 and 2.

(15) FIGS. 24 and 25 are a top and a side views respectively of the post item 15 in FIGS. 1 and 2.

(16) FIGS. 26 and 27 are a front and a bottom views respectively of the physical exercising machine as in FIG. 1 with the addition of a motor item 19, 2 driving wheels assembly item 18 which consists of a bracket item **18*b* into which, an axle item 18*c* and 2 driving wheels item 18*a*, are mounted, a battery compartment item 20*a*, a battery item 20, a motor pulley and axle pulley items 26 and 25 respectively, a belt item 24, accessories such as wires items 21 and 20, a switch lever item 23 and a steering wheel assembly item 17**.

(17) FIG. 28 is a detailed view of said steering wheel assembly item 17 in FIG. 26 to show the bracket item **17*c*, axle item 17*b*, a steering wheel item 17*a* and said bracket item 17*c* which has an upper portion item 17*d* attached by a pin item 17*e* to the lower end of the pivot shaft item 9**.

DETAILED DESCRIPTION OF THE INVENTION AND ITS PREFERRED EMBODIMENT

Figures 5, 6, 7, 8, 9, 10, 11, 12, 13, 14, 15, 16, 17, 18, 19, 20, 21, 22, 23, 24, 25:
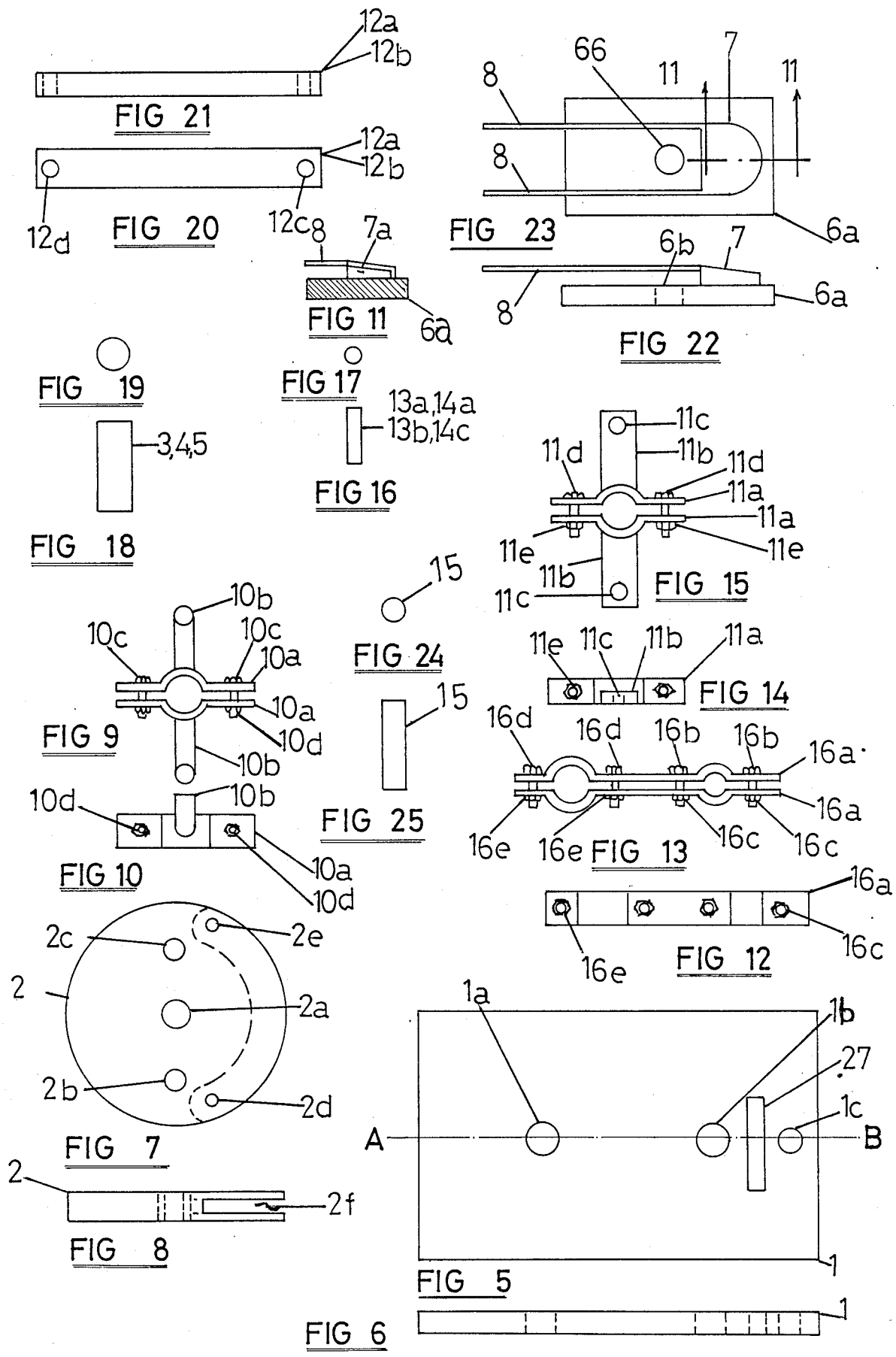

A portion of the physical exercising machine according to the invention is shown in FIGS. 1 and 2, which includes; a base board item 1 which is detailed in FIGS. 5 and 6, have item **1*a* is the first pivot aperture and item 1*c* is a hole into which a post item 15 FIG. 1 is fixed and, attached to, said post, a clamping assembly (item 16 FIG. 1) which is illustrated in FIGS. 12 and 13, can be tightened onto said post by the bolts and nuts items 16*b* and 16*c* respectively, and said clamping assembly is adjustably tightenable around the pivot shaft item 9 FIG. 1 and so exerts friction resistance by tightening the bolts and nuts items 16*d* and 16*e* respectively on said pivot shaft as illustrated in FIG. 1. Said base, also, has an opening item 27 FIG. 5** and through said opening the user can see any markings on the floor, on which said base is positioned.

In FIG. 1, item 9 is a pivot shaft which has its lower end is positioned, and is free to rotate, into the second pivot aperture item **1*b* FIG. 5. To said pivot shaft, close and above said base, is attached a cross bar assembly item 11 FIG. 2, which is illustrated in FIGS. 14 and 15, is tightened around said pivot shaft by the bolts and nuts items 11*d* and 11*e*** respectively.

Note: items 11*a* and 11*b* in FIG. 15 are two attached or welded parts of each half of said cross bar assembly and item 11*c* FIG. 15 is a hole for the primary pivot pin which is illustrated in FIGS. 16 and 17 which can go through said hole. To the upper part of said pivot shaft (item 9 FIG. 1), at the desired height, a handle assembly item 10 (FIG. 1), which is illustrated in FIGS. 9 and 10, is tightened to said pivot shaft by the bolts and nuts items 10*c* and 10*d* respectively.

Note: items 10*b* and 10*a* in FIGS. 9 and 10 are two attached or welded parts of each half of said handle assembly.

In FIG. 1, item 2 is a disc, which is illustrated in FIGS. 7 and 8, has a center aperture items 2*a* FIG. 7 and a primary pivot pin item 3 FIG. 1 which is illustrated in FIGS. 18 and 19, has its upper end into said center aperture item 2*a* and its lower end into said first pivot aperture item 1*a* of the base item 1 FIG. 5, and said disc is free to rotate relative to said base around said primary pivot pin. Also said disc (FIGS. 7 and 8) has 2 holes items 2*d* and 2*e* respectively, and a groove item 2*f*, so that the linkage members items 12*a* and 12*b* (FIG. 2), which are detailed in FIGS. 20 and 21, have end holes items 12*d* and 12*c*, are connected between said disc and said cross bar assembly by using pivot pins items 13*a*, 13*b*, 14*a* and 14*c* as illustrated in FIG. 2. Said pivot pins are shown in FIGS. 16 and 17.

Note: In FIG. 2, items 14*b* and 14*d* are alternative positions of items 14*a* and 14*c* respectively when said disc is rotated clockwise (FIG. 2).

Said disc, item 2 in FIGS. 1 and 2 has 2 separate means item 6 to support the two feet of the exerciser. Each of said 2 separate means is illustrated in FIGS. 22, 23 and 11 and consists of a foot piece item 6*a*, a pocket item 7 and 2 laces item 8 to secure the foot into said pocket which is attached to said foot piece.

The foot piece item 6*a* has a hole item 6*b* (FIG. 23) through which one end of a pivot pin item 5 or 4 (FIGS. 1 and 2) is inserted and the other end of said pivot pin is inserted in one of the 2 holes items 2*b* or 2*c* in said disc (FIG. 7).

Note: Said pivot pins items 5 or 4 (FIG. 1 and 2) are also shown in FIGS. 18 and 19. FIG. 2 illustrates two of said separate means, one for the right foot with a pivot pin item 4 and the other is for the left foot with a pivot pin item 5.

Figure 27:
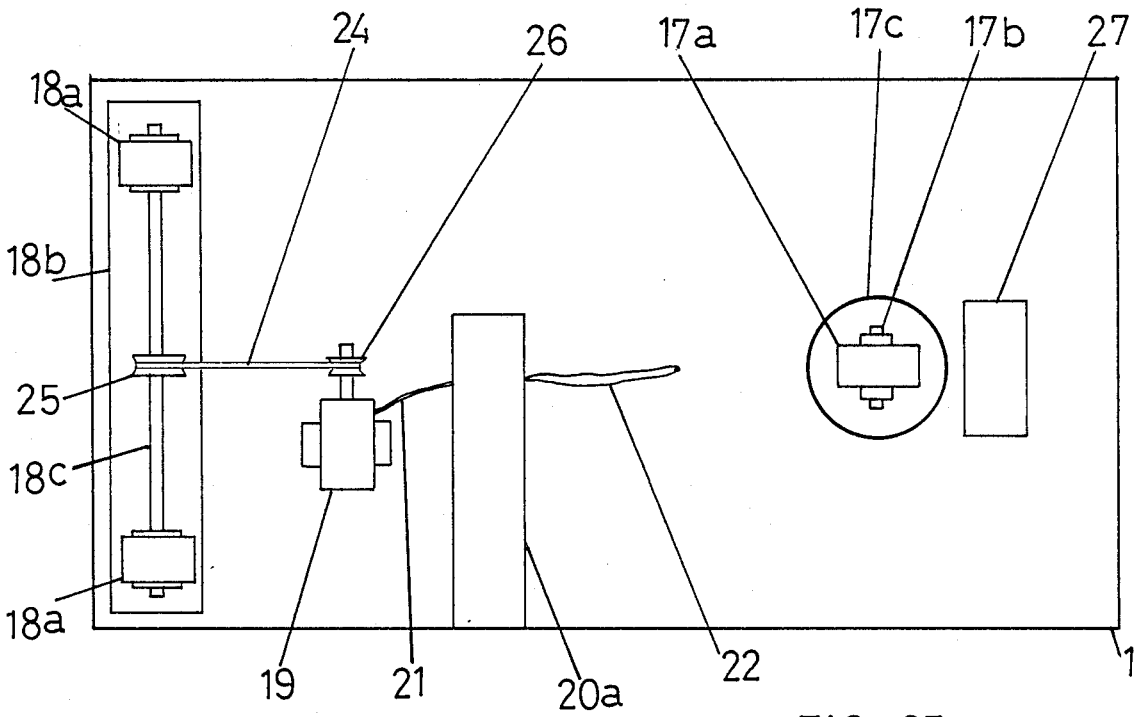
Figure 28:
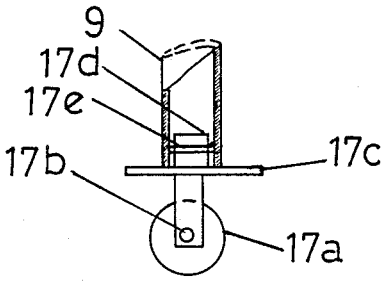
Figure 26:
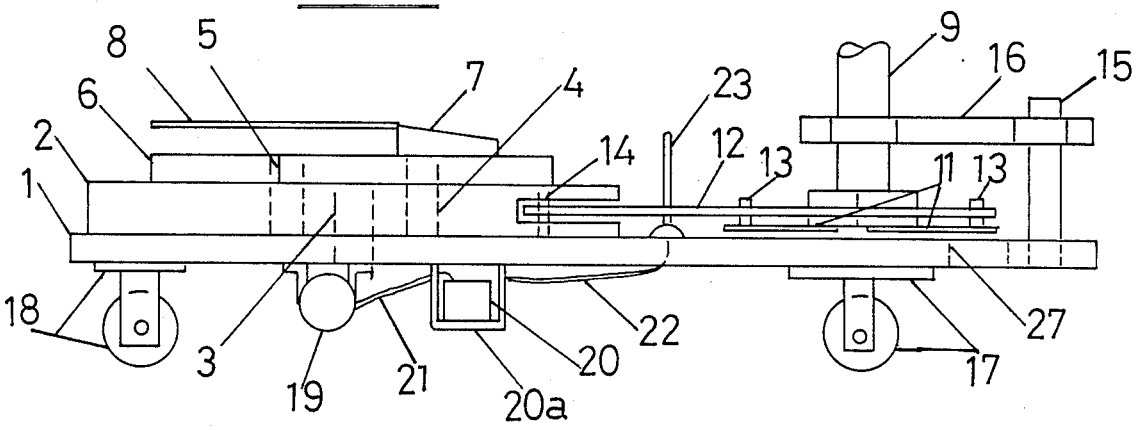

Note: items 5*a*, 5*b* and items 4*a* and 4*b* are the positions of the pivot pins 5 and 4 respectively when said disc item 2 is rotated one way or the other in an oscillatory motion around the primary pivot pin item 3 (FIGS. 1 and 2), relative to said base board item 1. The preferred embodiment of the invention is illustrated in FIGS. 26, 27, which are similar to FIGS. 1 and 2 but show extra items such as 2 driving wheels assembly item 18, which consists as in FIG. 27, of 2 wheels item 18*a*, axle item 18*c* and a pulley item 25 and an assembly bracket item 18*b*, a battery item 20 in its compartment item 20*a*, a motor item 19 and its pulley item 26, a belt item 24, wires items 21 and 22 and a switch lever item 23. Also attached to said pivot shaft a steering wheel assembly item 17 in FIG. 26 which is detailed in FIG. 28 which shows a bracket item 17*c* which carries a wheel item 17*a* mounted on the axle item 17*b* and said bracket has an upper portion item 17*d* attached by a pin item 17*e* to the lower end of said pivot shaft item 9 in FIG. 26.

The user of the preferred embodiment of the invention is able to exercise his whole body while the exercise machine is driven or moving by the battery/motor mechanism, and it is the challenge for the exerciser to control and observe that the steering wheel is following a certain path marked on the floor, and if the exerciser misses said path an electronic device such as an electronic eye will record any such deviation against the exerciser.

It is clear that the invention exercises the whole body of the user, not only the muscles and the bones of the body but also the senses, sight, alertness of the mind and of being excited to win in a competition among the exercisers.

The invention shows a unique exercise machine, to build the whole body as muscles, mind and soul to be a healthier individual in easy way not available by the prior art.

NOTES (1) The user of the invention can also sit on a suitable swivable and height-adjustable chair which is to be attached to the center of said disc (item 2 FIGS. 2 and 26). Such a chair which can also be adjusted in height, is not shown in any of the accompanied drawings.

(2) The invention can be used by trained, live animals or dummy characters such as a doll, teddy bear, etc. to give an eye pleasing movements and beautiful colors when the colorful plastic material is used in the construction of said invention, and said invention can be a toy amuses who watches its movements which provide a fascinating toy.

(3) The machine of this invention can be constructed from waterproof materials to render said machine be waterproof and can be used in water.

(4) It will be evident that there are numerous embodiments of the invention are not described, but are clearly within the scope and the spirit of the invention. The above description is intended to be exemplary only and the scope of the invention is to be limited solely by the appended claims.

I claim:

1. An exercise machine comrpising:

a base board, said base board having in its top surface first, second and third spaced pivot apertures, said second aperture being between said first and third apertures;

a primary pivot pin mounted in said first pivot aperture;

a disc centrally mounted on said primary pivot pin, said disc having separate means for retaining each foot of the user, and said disc further having secondary pivot pins on each side of said primary pivot pin;

a pivot shaft mounted in said second pivot apeture;

a cross bar attached to and extending from opposite sides of said pivot shaft, the opposite ends of said cross bar having pivot pins;

a pair of linkage members, each linkage member connecting a pivot pin on said cross bar to a respective secondary pivot pin on said disc;

a handle assembly mounted on said shaft above the plane of the disc a sufficient distance for the user to stand on the disc and grasp the handle assembly;

a post mounted in said third aperture; and a clamping assembly connecting said pivot shaft with said post, said clamping assembly being adjustably tightenable about said pivot shaft such that the frictional resistance to rotation of the pivot shaft may be adjusted, whereby a user may stand on said disc and rotate the handle against the frictional resistance of the clamping assembly such that rotation of the handle causes rotation of the disc.

2. The exercise machine of the claim 1 wherein the exercise machine is constructed of waterproof materials.

3. An exercise machine comprising:

a base board, said base board having in its top surface first and second spaced pivot apertures;

a primary pivot pin mounted in said first pivot aperture:

a disc centrally mounted on said primary pivot pin, said disc having separate means for retaining each foot of the user, and said disc further having secondary pivot pins on each side of said primary pivot pin;

a pivot shaft mounted in said second pivot aperture;

a cross bar attached to and extending from opposite sides of said pivot shaft, the opposite ends of said cross bar having pivot pins;

a pair of linkage members, each linkage member connecting a pivot pin on said cross bar to a respective secondary pivot pin on said disc;

a handle assembly mounted on said shaft above the plane of the disc a sufficient distance for the user to stand on the disc and grasp the handle assembly; and three wheels mounted beneath the base for engaging a floor surface, two said wheels being driving wheels connected by a common axle and the third said wheel being mounted on said pivot shaft for steering said exercise machine, whereby a user may stand on said disc and rotate the handle to control the steering of the disc and cause rotation of the disc.

4. The exercise machine of claim 3 further comprising a motor mounted on the base, said motor being operatively connected with said axle for driving said driving wheels.

5. The exercise machine of claim 3 wherein the exercise machine is constructed of waterproof materials.

6. The exercise machine of claim 4 further comprising an electronic eye mounted on said machine wherein a user may attempt to follow a marked path on the floor surface and said electronic eye will detect any deviation of the machine from the marked path.

* * * * *